US009745828B2

(12) United States Patent
Telfer

(10) Patent No.: US 9,745,828 B2
(45) Date of Patent: Aug. 29, 2017

(54) VALVE SEAT ASSEMBLY, DOWNHOLE TOOL AND METHODS

(71) Applicant: Specialised Petroleum Services Group Limited, Aberdeen, Aberdeenshire (GB)

(72) Inventor: George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 0 days.

(21) Appl. No.: 13/935,076

(22) Filed: Jul. 3, 2013

(65) Prior Publication Data

US 2013/0291962 A1 Nov. 7, 2013

Related U.S. Application Data

(63) Continuation of application No. 12/527,395, filed as application No. PCT/GB2008/000491 on Feb. 13, 2008, now abandoned.

(30) Foreign Application Priority Data

Feb. 16, 2007 (GB) ..... 0703021.6

(51) Int. Cl.
*E21B 34/14* (2006.01)
*E21B 21/10* (2006.01)
*E21B 34/00* (2006.01)

(52) U.S. Cl.
CPC ..... *E21B 34/14* (2013.01); *E21B 21/103* (2013.01); *E21B 2034/002* (2013.01); *Y10T 137/0318* (2015.04); *Y10T 137/7069* (2015.04)

(58) Field of Classification Search
CPC .. E21B 2034/002; E21B 21/103; E21B 34/08; E21B 34/10; E21B 34/14;
(Continued)

(56) References Cited

U.S. PATENT DOCUMENTS 3,548,977 A * 12/1970 Franks ..... 188/282.5
4,757,884 A * 7/1988 Fannin et al. ..... 188/282.4
(Continued)

FOREIGN PATENT DOCUMENTS

EP 1331356 A2 7/2003
WO 2004/088091 A1 10/2004
WO 2005/106186 A1 11/2005

OTHER PUBLICATIONS

International Search Report for PCT/GB2008/000491 mailed Oct. 6, 2008 (5 pages).
(Continued)

*Primary Examiner* — William McCalister
(74) *Attorney, Agent, or Firm* — David Joshua Smith

(57) ABSTRACT

A circulation tool includes a tubular outer body having a main bore and at least one flow port in a wall thereof, and a valve seat assembly including a valve body, a valve member, and locking elements are movably mounted within the outer body main bore. The valve seat assembly is biased towards a first position in which flow through the outer body flow port is prevented and the locking element is in the extended position, restricting passage of the valve member along the valve body bore and out of the valve body. The valve seat assembly is movable to a second position in which the locking element is in the retracted position, permitting passage of the valve member along the body bore and out of the body. The valve seat is also movable to a third position in which flow through the outer body flow port is permitted.

16 Claims, 9 Drawing Sheets

(58) Field of Classification Search
CPC ..... E21B 23/08; Y10T 137/7854; Y10T 137/7855; Y10T 137/7856; Y10T 137/791; Y10T 137/7879; Y10T 137/788; Y10T 137/7069
USPC .... 137/515, 515.3, 515.5, 843, 844, 533.11; 251/318; 166/373, 374, 375
See application file for complete search history.

(56) References Cited

U.S. PATENT DOCUMENTS

| | | | | | |
|---|---|---|---|---|---|
| 4,964,492 | A | * | 10/1990 | Joseph | 188/282.4 |
| 5,020,612 | A | * | 6/1991 | Williams | 175/234 |
| 5,146,992 | A | * | 9/1992 | Baugh | 166/383 |
| 5,462,121 | A | * | 10/1995 | Schmuck et al. | 166/383 |
| 6,084,052 | A | * | 7/2000 | Aufdermarsh | E21B 47/011 156/160 |
| 6,978,842 | B2 | * | 12/2005 | Read, Jr. et al. | 166/383 |
| 7,021,389 | B2 | * | 4/2006 | Bishop et al. | 166/373 |
| 7,047,994 | B2 | * | 5/2006 | McPeak | A61M 39/22 137/15.24 |
| 7,150,326 | B2 | * | 12/2006 | Bishop et al. | 166/373 |
| 2003/0136563 | A1 | | 7/2003 | Allamon et al. | |
| 2004/0000406 | A1 | | 1/2004 | Allamon et al. | |
| 2004/0163820 | A1 | * | 8/2004 | Bishop et al. | 166/373 |
| 2008/0251744 | A1 | * | 10/2008 | Goscinski | 251/63.5 |

OTHER PUBLICATIONS

Written Opinion of ISA for PCT/GB2008/000491 mailed Oct. 6, 2008 (10 pages).
Australian Examination Report for corresponding Australian Application No. 2008215996 dated Jan. 15, 2014, 4 pages.

* cited by examiner 10
38
152
154
36
140
142
40

VALVE SEAT ASSEMBLY, DOWNHOLE TOOL AND METHODS

CROSS-REFERENCE TO RELATED APPLICATIONS

This is a continuation application and claims benefit under 35 U.S.C. §120 of U.S. patent application Ser. No. 12/527,395, filed on Oct. 13, 2009, which is the National Stage of the International Application PCT/GB2008/000491, filed Feb. 13, 2008. All of these applications are incorporated by reference in their entirety.

TECHNICAL FIELD OF THE INVENTION

The present invention relates to a valve seat assembly, a downhole tool/circulation tool incorporating a valve seat assembly, a method of controlling fluid flow and a fluid circulation method. In particular, but not exclusively, the present invention relates to a valve seat assembly having a valve body adapted to sealingly receive a valve member such as a ball; a downhole tool/circulation tool incorporating such a valve seat assembly; and methods of controlling fluid flow and of circulating fluid by bringing a valve member into sealing abutment with a body of a valve seat assembly. The present invention also relates to a seal assembly, a seal, an indexing arrangement and an indexing member for use with a downhole tool.

BACKGROUND TO THE INVENTION

In the oil and gas exploration and production industry, a wellbore or borehole of an oil or gas well is typically drilled from surface to a first depth and lined with a steel casing which is cemented in place. The borehole is then extended and a further section of smaller diameter casing is located in the extended section and also cemented in place. This process is repeated until the wellbore has been extended to a desired depth, intersecting a producing formation. In an alternative, tubing known as a liner is located in the borehole, extending from the deepest casing section to a producing formation, and is also cemented in place. The well is then completed by locating a string of production tubing within the casing/liner, through which well fluids flow to surface.

Before the well can be completed, it is necessary to clean the lined wellbore and to replace the fluids present in the wellbore with a completion fluid such as brine. The cleaning process serves to remove solids adhered to the wall of the casing or liner; to circulate residual drilling mud and other fluids out of the wellbore; and to filter out solids present in the wellbore fluid. A considerable amount of debris in the wellbore and on the surface of the casing/liner comprises rust particles and metal chips or scrapings originating from equipment used in the well and the casing or liner itself.

A cleaning operation typically involves carrying out a mechanical cleaning procedure, where an abrasive cleaning tool is reciprocated back and forth within the wellbore tubing, to remove the solids adhered to the tubing wall. Other cleaning procedures may involve jetting fluid on to a wall of the wellbore tubing at a desired location using a circulation tool, to assist in solid particle removal, and to circulate the solids to surface. Typically, a tool string is assembled which incorporates one or more mechanical cleaning tools and a circulation tool. Following a mechanical cleaning of the wellbore tubing, the circulation tool is activated at a desired location, to jet fluid on to the wellbore tubing wall to further clean the tubing.

In order to achieve this, it is necessary to provide a circulation tool which can be selectively activated downhole. One such suitable circulation tool is disclosed in the Applicant's International Patent Application No. PCT/GB2004/001449, published as WO 2004/088091. The circulation tool disclosed in WO 2004/088091 is activated to circulate fluid from an internal bore of the tool to the tool exterior by dropping valve members in the form of balls into the tool. The balls seat on a ball seat of the tool, to selectively close fluid flow through a main bore of the tool, thereby permitting movement of an internal sleeve to open flow to the tool exterior. The tool can be repeatedly cycled to open and close flow to the tool exterior by dropping a succession of balls, which are blown through the ball seat to permit further operations. This is typically achieved by providing a deformable ball seat, although deformable balls may be utilised.

Whilst the circulation tool disclosed in WO 2004/088091 is effective at circulating fluid to the tool exterior, it is desired to improve upon the operation of the tool and the methods utilised for circulating fluid disclosed therein. In particular, the deformable materials utilised in the manufacture of the deformable ball seat/balls can be affected by changing downhole conditions, such as variations in temperature and pressure. This can lead to variations in the operating parameters of the tool.

It is also desired to improve upon other features of the tool disclosed in WO 2004/088091. For example, the circulation tool of WO 2004/088091 requires that an index sleeve be cycled back and forth within a main bore of the tool, to permit repeated opening and closing of fluid flow to the tool exterior when balls are seated on the ball seat. The sleeve is biased by a spring located in a spring chamber defined between an outer body of the tool and the indexing sleeve. This chamber must be open to fluid ingress/egress, in order to permit pressure equalisation during running-in and pulling-out of the tool. Over time, repeated cycling of the indexing sleeve results in the ingress of solids-laden fluids, particularly drilling fluids. The solids in these fluids have been found to settle out over time, and can restrict movement of the indexing sleeve and/or operation of the biasing spring.

Additionally, the circulation tool of WO 2004/088091 includes indexing pins or dogs which govern the axial and rotational position of the indexing sleeve relative to the tool outer body. These dogs are of a conventional type, and are cylindrical in shape. Whilst cylindrical dogs of this type are effective in cycling the indexing sleeve, it has been found that the circular section of the pins does not provide the optimum force transfer to the indexing sleeve, and increases the chance of dog fracture over time.

It is therefore amongst the objects of embodiments of the present invention to obviate or mitigate at least one of the foregoing disadvantages.

SUMMARY OF THE INVENTION

According to a first aspect of the present invention, there is provided a valve seat assembly comprising:

a valve body adapted to sealingly receive a valve member, the body having a bore therethrough and being deformable to permit passage of the valve member along the body bore and out of the body; and at least one locking element mounted for movement relative to the body between a retracted position in which the locking element permits passage of the valve member along the body bore and out of the body, and an extended position in which the locking element restricts passage of the valve member along the body bore and out of the body.

Providing a valve seat assembly having a deformable valve body, and a locking element which selectively restricts passage of the valve member along the body bore and out of the body, permits a good seal between the valve member and the valve body whilst ensuring that the valve member will not be prematurely or inadvertently blown through the valve seat, due, for example, to variations in well conditions such as temperature and pressure.

Accordingly, the valve seat assembly can be selectively and reliably operated under varying well conditions.

Preferably, the locking element is of a material which is less deformable than a material of the valve body. Thus the locking element may support an applied load, which would be sufficient to deform the valve body, with little or no resultant deformation. Accordingly, the valve body may be deformed by the valve member, when a sufficient fluid pressure force is applied to the valve member, but the locking element will prevent passage of the valve member along the valve body bore and out of the valve body. The locking element may be of a material having a higher material hardness than the material of the valve body. In an embodiment of the invention, the valve body may be of a plastics material and the locking element may be of a metal or metal alloy. In a preferred embodiment, the valve body is of polyetheretherketone (PEEK). PEEK has been found to perform well in downhole environments when exposed to high temperatures, fluid pressures and corrosive materials; provides a good seal with other components such as the valve member; and is elastically deformable on application of a deformation load, returning to a pre-deformation state in the absence of the applied load, ready for receiving a further valve member.

The valve body may define a valve seat adapted to sealingly abut or receive the valve member. The valve seat may be defined by a surface of the valve body, and may be inclined relative to a main axis of the valve body bore or chamfered. The valve seat may alternatively be defined by a valve seat member coupled to or mounted on the valve body.

The valve body bore may be of a diameter which is less than an operating diameter of the valve member, to provide an interference fit with the valve member. In this fashion, when a valve member is brought into abutment with the valve body, the valve member may seal against and with respect to the valve body. Pressuring-up behind the valve member may then facilitate deformation of the valve body and blow-through of the valve member when free to do so (depending upon the position of the locking element). The operating diameter of the valve member will depend upon the shape of the valve member used. Typically, valve members in the form of balls will be utilised, where the operating diameter is the diameter of the ball. However, other types of valve member may be utilised, such as generally conical darts, where the operating diameter is the maximum outer diameter of the dart.

In the extended position, the locking element may define or describe a clearance or space within the body bore which is at least equal to the diameter of the body bore in an undeformed state. Accordingly, in the extended position, the locking element may effectively maintain the diameter of the body bore to a diameter which is less than that of the valve member, thereby restricting passage of the valve member out of the body. The locking element therefore defines a restriction to passage of the valve member along the body bore, as the locking element is not deformed by the valve member as is the valve body. In an embodiment of the invention, the locking element may extend or protrude into the body bore, when in the extended position, to restrict passage of the valve member along the bore and out of the valve body. In the retracted position, the locking element may be in a position such that the locking element is retracted from the body bore and thus so that the locking element describes or defines a clearance or space within the body bore which is less than the diameter of the body bore in an undeformed state, and greater than a diameter of the valve member, so that the locking element does not restrict the bore of the valve body. Thus in the retracted position of the locking element, the minimum diameter of the valve seat assembly is defined or described by the valve body.

The locking element may define an abutment surface adapted to abut the valve member. The abutment surface may be defined by a surface of the locking element, and may be inclined relative to a main axis of the valve body bore or chamfered. The abutment surface may alternatively be defined by an abutment portion coupled to or mounted on the locking element.

The valve seat assembly may comprise a support sleeve or body in which the valve body is mounted and an aperture, the aperture adapted to receive the locking element and to permit outward movement of the locking element relative to the valve body. This may facilitate movement of the locking element from the extended position to the retracted position, to permit passage of the valve member along the body bore. The valve body may be mounted for axial movement within and relative to the support sleeve, and axial movement of the valve body relative to the support sleeve may permit movement of the locking element between the extended and retracted positions.

Alternatively, the support sleeve may comprise a recess, channel or groove, which recess or the like may be of a diameter greater than a diameter of a main part of the support sleeve. The locking element may then be adapted to move out into the recess or the like, for movement from the extended position to the retracted position.

The valve body may be movable relative to the support sleeve between a first position in which the locking element is in the extended position, restricting passage of the valve member along the valve body bore and out of the valve body; and a second position in which the locking element is in the retracted position, permitting passage of the valve member along the body bore and out of the body. The valve body may be biased towards the first position. The valve body may also be movable to a third position in which the locking element is again in the extended position, and the third position may be an intermediate position, at a location axially between the first and second positions. The valve body may be movable from the first position towards the second position by bringing a valve member into sealing abutment with the valve body and raising a fluid pressure force acting on the valve member so as to urge the valve body to the second position, whereupon the locking element moves to the retracted position such that the valve member is permitted to pass through the valve body. The valve body may then be adapted to move to the third position where the locking element is returned to the extended position. Locating a further valve member on the valve body may then move the valve body back from the third position to the second position and, following passage of the further valve member through the valve body, the valve body may be adapted to return to the first position.

It will be understood that the valve body may be movable from the first position to the second position in response to application of a determined fluid pressure force on the valve member, said force being sufficient to overcome a biasing force exerted on the valve body which urges the valve body towards the first position.

Preferably, the valve seat assembly comprises a plurality of locking elements, and the locking elements may be spaced around a circumference or perimeter of the valve body. In a particular embodiment, the valve seat assembly may comprise three locking elements spaced equidistantly around the circumference of the valve body. The locking elements may be arcuate and may together define or describe an operating diameter of the valve body bore, when in their respective extended positions.

Preferably, the valve body comprises an aperture in which the locking element is movably mounted for movement between the extended and retracted positions. The aperture may extend through a sidewall of the valve body, and the aperture may be arranged on a radius of the valve body. In this fashion, the locking element may be radially movable between the extended and retracted positions, relative to the valve body. An axis of the aperture may be disposed parallel to the valve body radius, or may be inclined or declined relative to the radius.

The valve seat assembly may include a body comprising or defining a flow port in a wall thereof, which flow port may be located in a position downstream of the locking element (for flow from surface downhole), and the flow port may be adapted to permit fluid flow from the valve body bore to an exterior of a downhole tool in which the valve seat assembly is located.

According to a second aspect of the present invention, there is provided a downhole tool comprising a valve seat assembly according to the first aspect of the invention.

According to a third aspect of the present invention, there is provided a method of controlling fluid flow through a conduit, the method comprising the steps of:

mounting a valve seat assembly in a fluid conduit;

flowing fluid along the conduit and through a bore of a valve body of the valve seat assembly;

bringing a valve member into sealing abutment with the valve body, to restrict further fluid flow through the valve seat assembly;

locating a locking element of the valve seat assembly in an extended position, to restrict passage of the valve member along the body bore and out of the body;

selectively moving the locking element from the extended position to a retracted position in which the locking element permits passage of the valve member along the body bore and out of the body; and selectively urging the valve member along the valve body bore such that the valve member deforms the valve body and passes out of the body, to thereby reopen fluid flow through the valve seat assembly.

Bringing the valve member into sealing abutment with the valve body may close the conduit to prevent further passage of fluid along the conduit. In an alternative, the valve member may be brought into substantial sealing abutment, permitting a partial flow of fluid along the conduit past the valve member; however, the valve member will greatly reduce the fluid flow.

The step of locating the locking element in the extended position may comprise locating the valve body in a position where the locking element is supported in the extended position. The valve body may be located in a first position where the locking element is supported and held in the extended position, and the valve body may be biased towards the first position. The locking element may be moved from the extended position to the retracted position by raising a fluid pressure force acting on the valve member, when the valve member is located in sealing abutment with the valve body, to exert a force on the valve body to thereby move the valve body away from the first position to a second position in which the locking element is permitted to move from the extended position to the retracted position. The valve body may be urged against a biasing force to the second position, where the locking element may be desupported, such that the valve member may urge the locking element outwardly for passage through the body bore.

The valve body may be moved to the second position by raising a fluid pressure force acting on the valve member, and the fluid pressure force may be raised above a determined level at which the valve body is movable to the second position. The valve member may be urged along the valve body bore and out of the valve body by raising a fluid pressure force acting on the valve member. The pressure at which the locking element is moved from the retracted position to the extended position may be less than or equal to the pressure at which the valve member deforms the valve body, such that the valve member is moved along the valve body bore only when the locking element has been moved to, or as the locking element is moved to, the retracted position.

The method may be a method of controlling fluid flow along a main bore of a conduit and through a flow port in a wall of the conduit to an exterior of the conduit. To achieve this, following movement of the valve member along the valve body bore and out of the valve body, fluid flow through the flow port to the exterior of the conduit may be opened. The valve body may then be moved to a third position in which the flow port is open, following expulsion of the valve member from the valve body, which third position may be axially between the first and second positions.

The method may comprise bringing a first valve member into sealing abutment with the valve body, to carry out the above steps and to open flow to the exterior of the conduit. The method may also comprise bringing a further valve member into sealing abutment with the valve body, to move the valve body from the third position back to the second position. The further valve member may then be urged along the valve body bore and out of the body, whereupon the valve body may be returned to the first position. The tool is then reset with the flow port closed and is ready to receive a still further valve member, for reopening the flow port, when required.

The method may comprise bringing a first valve member into sealing abutment with the valve body, to carry out the above steps and to open flow to the exterior of the conduit. The method may also comprise passing a further valve member, of a diameter less than that of the first valve member, through the valve body bore past the locking element and into abutment with a valve seat disposed downstream of the locking element, to close fluid flow along the conduit and to direct substantially all or all fluid flow through the flow port and to the exterior of the conduit. Flow through the conduit may be reopened by raising a fluid pressure force acting on the further valve member, to blow the valve member through the valve seat. To achieve this, the valve seat or the further valve member may be deformable.

It will be understood that the conduit may be any type of downhole conduit, in particular a body of a downhole tool such as a circulation tool, but that the conduit may be a section of alternative downhole tubing, or indeed of tubing used in alternative environments such as within a pipeline.

According to a fourth aspect of the present invention, there is provided a circulation tool comprising: a generally tubular outer body having a main bore for the flow of fluid therethrough and at least one flow port in a wall thereof; and a valve seat assembly movably mounted within, the outer body main bore, the valve seat assembly comprising a valve body adapted to sealingly receive a valve member, the valve body having a bore therethrough and being deformable to permit passage of the valve member along the valve body bore and out of the valve body; and at least one locking element mounted for movement relative to the valve body between a retracted position in which the locking element permits passage of the valve member along the valve body bore and out of the valve body, and an extended position in which the locking element restricts passage of the valve member along the valve body bore and out of the valve body;

wherein the valve seat assembly is biased towards a first position in which flow through the outer body flow port is prevented and the locking element is in the extended position, restricting passage of the valve member along the valve body bore and out of the valve body;

and wherein the valve seat assembly is movable to a second position in which the locking element is in the retracted position, permitting passage of the valve member along the body bore and out of the body;

and further wherein the valve seat assembly is movable to a third position in which flow through the outer body flow port is permitted.

Further features of the valve seat assembly of the fourth aspect of the invention are defined above in relation to the first aspect of the invention.

The valve seat assembly may be movable from the third position to the second position, and from the second position to the first position, to facilitate resetting of the tool where the outer body flow port is closed and fluid flow through the outer body main bore is permitted.

The valve seat assembly, in particular the valve body, may be movable from the first position to the second position by bringing the valve member into sealing abutment with the valve body and exerting a fluid pressure force on the valve assembly. The valve seat assembly, in particular the valve body, may be movable from the second position to the third position by raising a fluid pressure force acting on the valve member, to urge the valve member along the valve body bore and out of the valve body. The valve seat assembly, in particular the valve body, may be movable from the third position back to the second position by bringing a further valve member into sealing abutment with the valve body and exerting a fluid pressure force on the valve assembly. The valve seat assembly, in particular the valve body, may be movable from the second position to the first position by raising a fluid pressure force acting on the further valve member, to urge the valve member along the valve body bore and out of the valve body.

According to a fifth aspect of the present invention, there is provided a method of selectively circulating fluid from an internal bore of a conduit to an exterior of the conduit, the method comprising the steps of: movably mounting a valve seat assembly in a fluid conduit;

flowing fluid along the conduit internal bore and through a bore of a valve body of the valve seat assembly;

bringing a valve member into sealing abutment with the valve body, to restrict further fluid flow through the valve seat assembly, thereby restricting fluid flow along, the internal bore of the fluid conduit;

locating a locking element of the valve seat assembly in an extended position, to restrict passage of the valve member along the body bore and out of the body;

selectively moving the locking element from the extended position to a retracted position in which the locking element permits passage of the valve member along the body bore and out of the body; and selectively urging the valve member along the valve body bore such that the valve member deforms the valve body and passes out of the body, to thereby open a fluid flow port in a wall of the conduit to permit fluid flow to the exterior of the conduit.

Further features of the method of the fifth aspect of the invention in common with the method of the third aspect are defined above.

According to a sixth aspect of the present invention, there is provided a seal assembly for a downhole tool comprising an outer tool body, an inner tool body located within the outer tool body and defining a fluid chamber therebetween, and an intermediate tool body located between the inner and outer tool bodies, at least part of the intermediate body residing within the chamber, the seal assembly comprising:

a first seal for sealing between the outer tool body and the intermediate tool body; and a second seal for sealing between the inner tool body and the intermediate tool body;

wherein one of the first and second seals is adapted to permit fluid flow into the chamber in a first axial direction of the tool and to restrict fluid flow from the chamber in a second axial direction of the tool opposite to said first direction;

and wherein the other one of the first and second seals is adapted to permit fluid flow out of the chamber in the second axial direction of the tool and to restrict fluid flow into the chamber in the first axial direction.

This provides the advantage that fluid entering the chamber (which, in a downhole environment, may be a solids-laden fluid such as drilling mud) in the first axial direction may be encouraged to leave the chamber in the second axial direction. Thus, for example, where the inner tool body is movable relative to the intermediate tool body, and/or where the intermediate tool body is movable relative to the outer tool body, repeated cycles of movement of the bodies may reduce the harmful effect that the ingress of solids-laden fluids may otherwise have on components of the tool located in the chamber, by encouraging the fluid to leave the chamber. Also, the chamber may be charged with fluid at surface and thus at a pressure lower than that experienced downhole. The seal assembly may allow fluid bleed into the chamber during run-in, and these fluids may be encouraged to leave the chamber during cycles of movement of the tool bodies. Furthermore, the seal assembly may allow fluid bleed out of the chamber during pull-out of the tool.

The first and second seals may be lip seals, may be generally C-shaped in cross-section, and may have first and second radially spaced lip portions, each lip portion adapted to seal against a respective one of the bodies. The lip portions may define an annular channel or recess therebetween. Lip seals of this shape provide an enhanced seal effect in one axial direction as, where a pressure differential exists across the seal, a fluid pressure force is exerted on the seal lip portions which urges the lip portions into enhanced sealing abutment with the respective bodies, or urges the lip portions out of sealing abutment with the respective bodies, depending upon the magnitude of the pressure differential (a higher pressure outside or within the chamber) relative to the seal orientation.

It will be understood that fluid flow is restricted in one of said directions, relative to the flow permitted in the other of said directions, in that fluid flow is reduced in one direction relative to the flow permitted in the other direction; or that fluid flow is prevented in one of said directions but allowed in the other one of said directions.

According to a seventh aspect of the present invention, there is provided a seal for a downhole tool comprising an outer tool body and an inner tool body located within the outer tool body and defining a fluid chamber therebetween, the seal adapted to seal between the outer and inner tool bodies and comprising:

a first seal portion and a second seal portion, one of the first and second seal portions being adapted to permit fluid flow into the chamber in a first axial direction of the tool and to restrict fluid flow from the chamber in a second axial direction of the tool opposite to said first direction, and the other one of the first and second seal portions being adapted to permit fluid flow out of the chamber in the second axial direction of the tool and to restrict fluid flow into the chamber in the first axial direction.

The seal may be a lip seal, and each seal portion may be generally C-shaped in cross-section and may have first and second radially spaced lip portions, each lip portion adapted to seal against a respective one of the bodies. The lip portions may define an annular channel or recess therebetween. The first and second seal portions may provide enhanced seal effects in one axial direction as, where a pressure differential exists across the seal, a fluid pressure force is exerted on the seal lip portions which urges the lip portions into enhanced sealing abutment with the respective bodies, or urges the lip portions out of sealing abutment with the respective bodies, depending upon the magnitude of the pressure differential (a higher pressure outside or within the chamber) relative to the seal orientation.

It will be understood that fluid flow is restricted in one of said directions, relative to the flow permitted in the other of said directions, in that fluid flow is reduced in one direction relative to the flow permitted in the other direction; or that fluid flow is prevented in one of said directions but allowed in the other one of said directions.

According to an eighth aspect of the present invention, there is provided an indexing arrangement for a downhole tool, the indexing arrangement comprising:

an indexing sleeve adapted to be axially and rotatably mounted relative to a body of a downhole tool, the indexing sleeve comprising an indexing channel in a surface thereof, the indexing channel including at least one first detent position, at least one second detent position axially spaced along the indexing sleeve from said first detent position, and at least one intermediate detent position provided at a location axially between said first and second detent positions, and wherein at least one of said detent positions defines an abutment surface which is inclined relative to a main axis of the indexing sleeve; and at least one indexing member adapted to be located in engagement with the indexing channel, the indexing member comprising at least one abutment surface disposed at an inclined angle relative to a main axis of the indexing sleeve which corresponds to that of the at least one detent abutment surface, to facilitate engagement of the indexing member with the indexing sleeve abutment surface during an indexing movement of the indexing sleeve.

According to a ninth aspect of the present invention, there is provided an indexing member for an indexing arrangement of a downhole tool comprising a tool body and an indexing sleeve axially and rotatably mounted relative to the tool body, the indexing sleeve comprising an indexing channel in a surface thereof including at least one detent position for the indexing member, the indexing member comprising:

at least one abutment surface disposed, in use, at an inclined angle relative to a main axis of the indexing sleeve, the inclined angle of the indexing member abutment surface corresponding to that of an at least one detent abutment surface of the indexing sleeve, to facilitate engagement of the indexing member with the indexing sleeve abutment surface during an indexing movement of the indexing sleeve.

The indexing sleeve may be adapted to be mounted within the body of the downhole tool, and the indexing channel may be in the outer surface of the indexing sleeve.

The indexing channel may be a continuous channel extending around a circumference or perimeter of the indexing sleeve. This may permit repeated cycling of the indexing sleeve between the detent positions.

The abutment surface of the indexing member may be a planar surface, and substantially an entire length of the indexing member abutment surface may be adapted to abut the abutment surface of the indexing sleeve, when the indexing member is in a detent position.

The indexing member may be of a polygonal shape in cross-section. The indexing member may comprise first and second opposite abutment surfaces, each abutment surface adapted to abut a respective, discrete abutment surface of the indexing sleeve. In this fashion, the indexing member may serve for location in a plurality of detent positions of the indexing member.

The abutment surface may be inclined at an angle of at least 35° relative to the main axis of the sleeve. In embodiments of the invention, the abutment surface of the indexing member may be inclined at an angle of between 35° and 40° relative to the sleeve main axis.

It will be understood that one or more features of the above described aspects of the present invention may be provided in combination in further aspects of the invention.

Embodiments of the present invention will now be described, with reference to the accompanying drawings.

MODES FOR CARRYING OUT THE INVENTION

Figure 11:
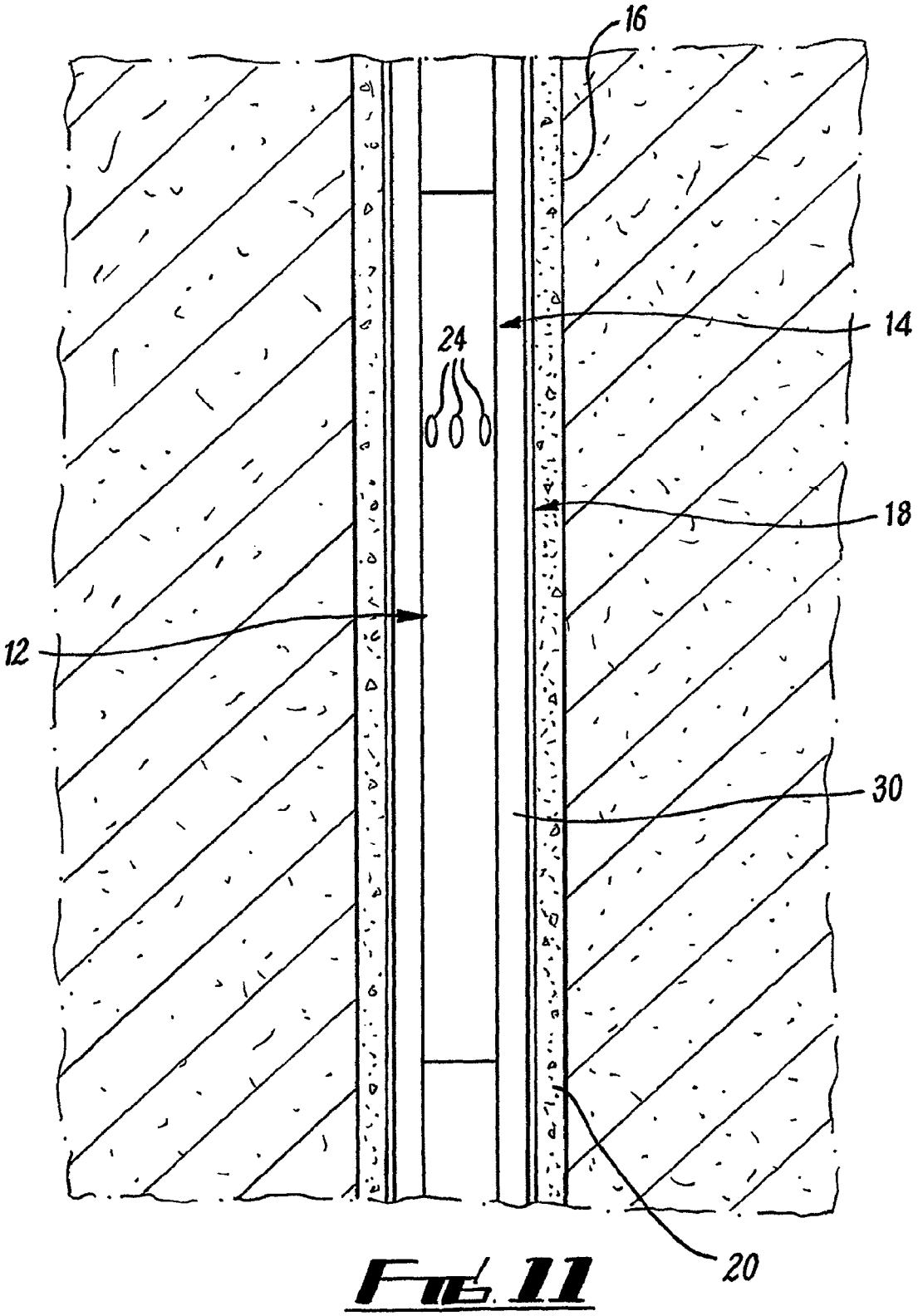
FIG. 11 is a view of the circulation tool of FIGS. 6 to 10, shown incorporated in a work string located in a wellbore which has been drilled from surface and lined with a metal casing that has been cemented in place.
Figure 12:
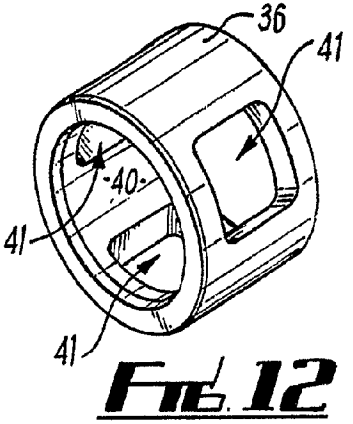
FIGS. 12 and 13 are perspective and top views, respectively, of a valve body of the valve seat assembly of FIGS. 1 to 5.
Figure 14:
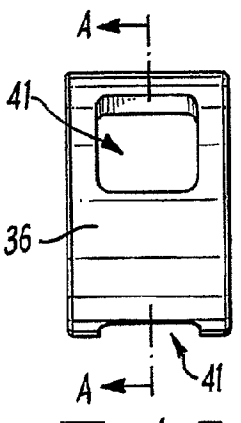
FIGS. 14 and 15 are side views of the valve body shown in FIGS. 12 and 13, taken in similar directions to the views of the valve seat assembly in FIGS. 4 and 5.
Figure 16:
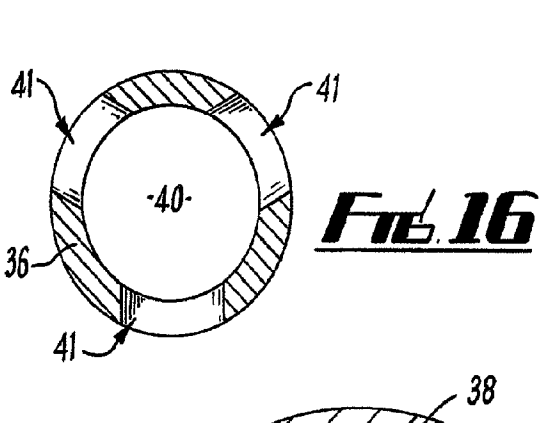
FIG. 16 is a sectional view of the valve body shown in FIGS. 12 to 15, section along line A-A of FIG. 7.
Figure 13:
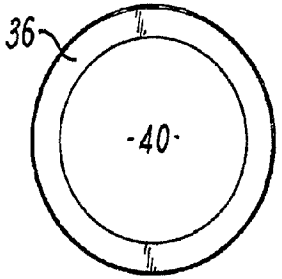
Figure 15:
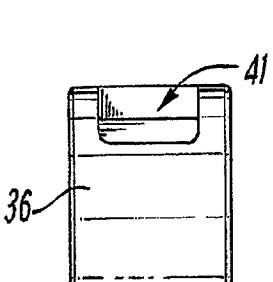

Turning firstly to FIGS. 1 to 5, there are shown perspective, top, bottom, and two side views (taken in different directions), respectively, of a valve seat assembly in accordance with an embodiment of the present invention. The valve seat assembly is indicated generally by reference numeral 10. The assembly 10 is suitable for use in a downhole tool and is shown incorporated in a downhole tool in the form of a circulation tool, illustrated from top to bottom in the various longitudinal half-sectional views of FIGS. 6 to 10, where the circulation tool is indicated generally by reference numeral 12. The circulation tool 12 is also shown incorporated in a work string 14 in the schematic view of FIG. 11. where the tool 12 is during run-into a wellbore 16 which has been drilled from surface and lined with a metal casing 18 which has been cemented in place with cement 20.

As will be described in more detail below, the circulation tool 12 is used to selectively circulate fluid from a main internal bore 22 of the tool 12 through flow ports 24, a number of which are provided spaced around a circumference of an outer body 26 of the tool 12. When the tool 12 is activated, fluid is directed from the main bore 22 through the flow ports 24, and is jetted on to an inner wall 28 of the casing 18, to wash solid debris from the casing wall 28 and to circulate the debris along an annulus 30 defined between an outer surface 32 of the string 14 and the casing wall 28 to surface. Activation of the tool 12 is governed by landing a valve member, in the form of a ball 34, on the valve seat assembly 10, to direct fluid through the flow ports 24.

Whilst the valve seat assembly 10 of the present invention is described herein for use in activation of the circulation tool 12, for circulating fluid into the annulus 30, it will be understood by persons skilled in the art that the assembly 10 has a utility in a wide range of different downhole tools, where it is desired to control fluid flow from a bore of a conduit (such as tool outer body 26) through a flow port (such as ports 24) in a wall of the conduit. Such fluid flow may be utilised to perform alternative functions downhole, such as to control activation of a further downhole tool. Equally, the assembly 10 has a utility in other, similar environments, such as within a pipeline, for controlling flow of a fluid from a conduit located within the pipeline to an exterior of the conduit.

Figures 1, 2, 3, 4, 5:
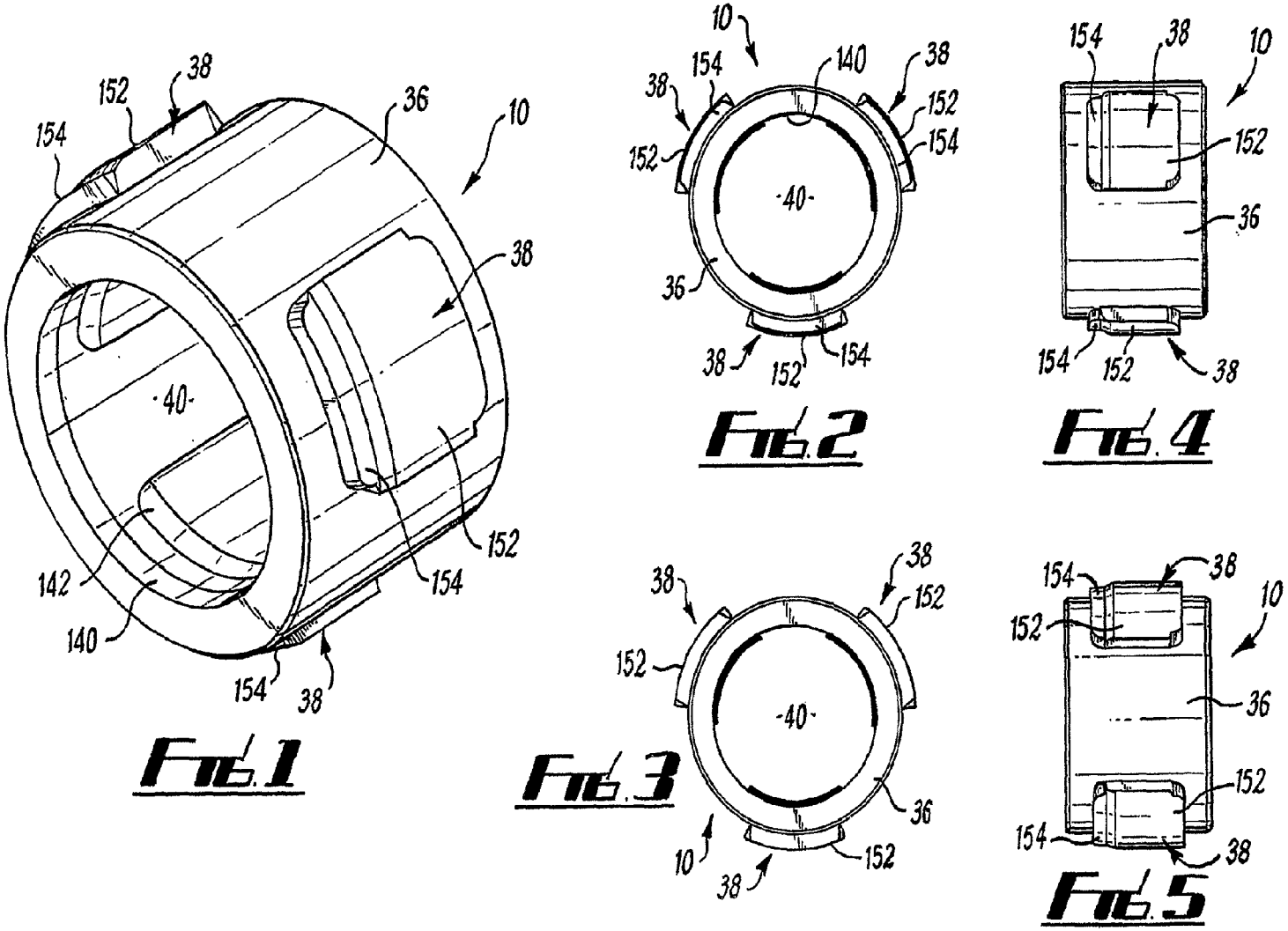
FIGS. 1 to 3 are perspective, top and bottom views, respectively, of a valve seat assembly in accordance with an embodiment of the present invention.
FIGS. 4 and 5 are side views, taken in different directions, of the valve seat assembly shown in FIGS. 1 to 3.
Figure 6:
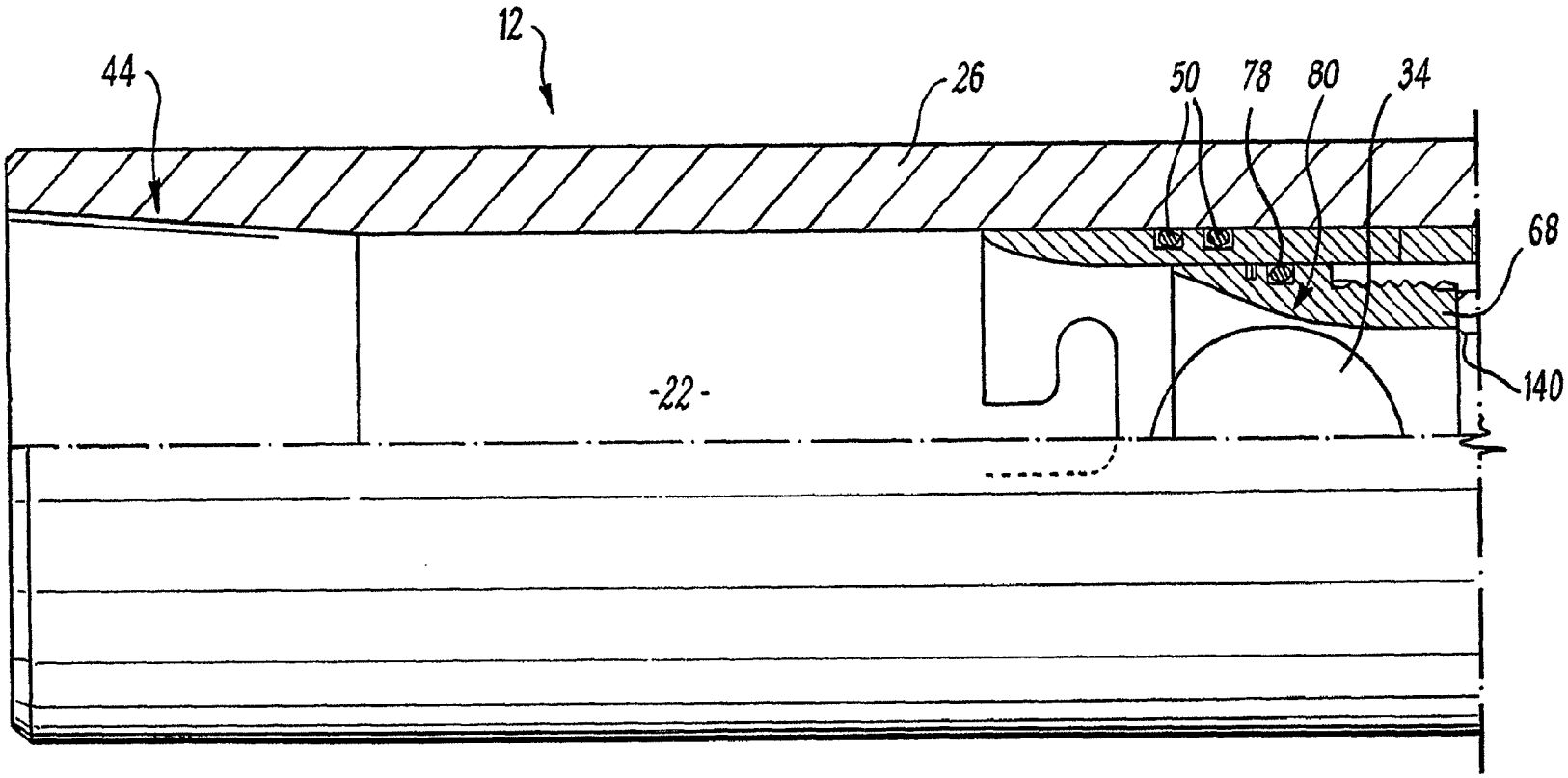
FIGS. 6 to 10 are longitudinal half-sectional views of a downhole tool in accordance with an embodiment of the present invention, incorporating the valve seat assembly of FIGS. 1 to 5, the downhole tool taking the form of a circulation tool and illustrated sequentially from top to bottom in FIGS. 6 to 10.
Figure 7:
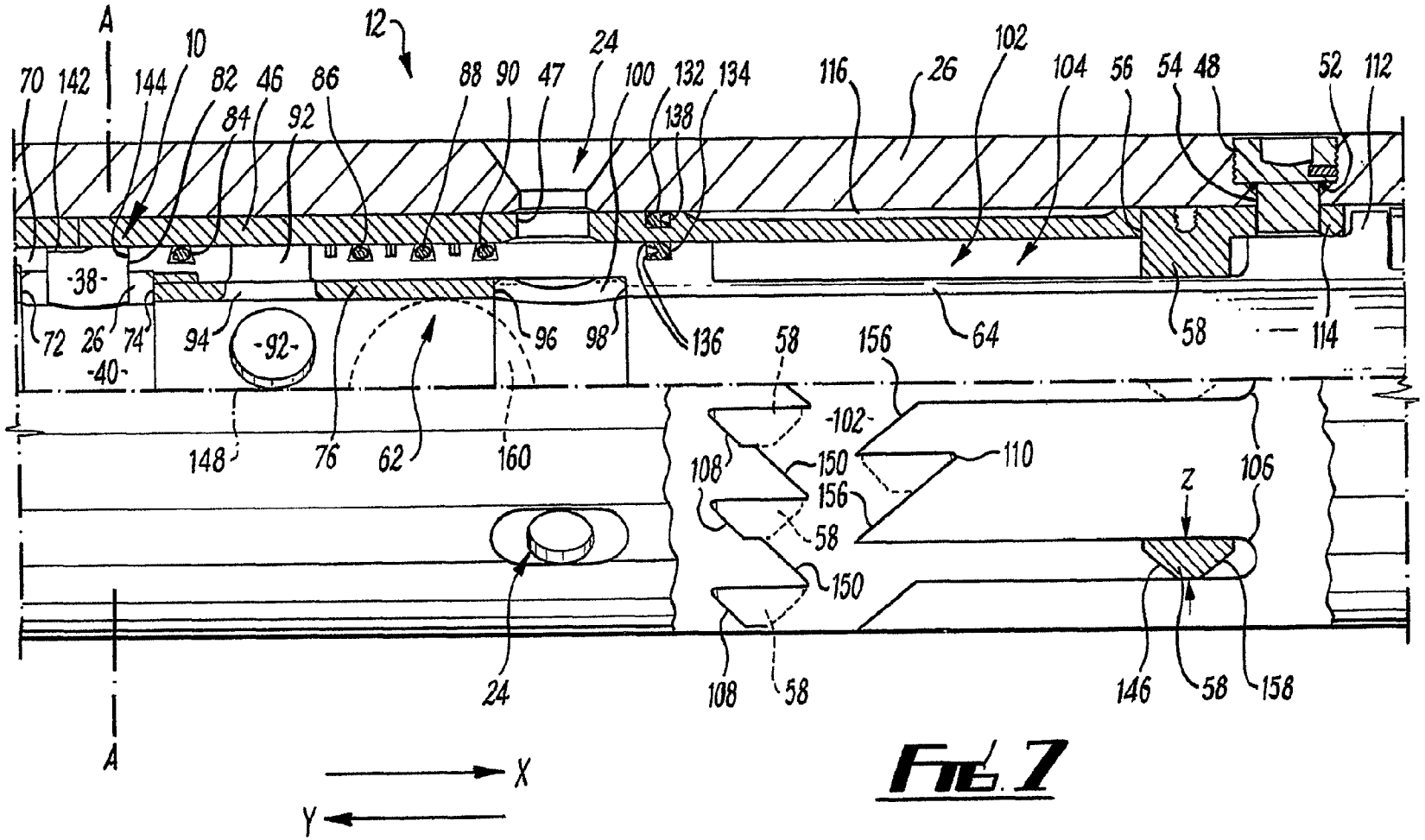
Figure 8:
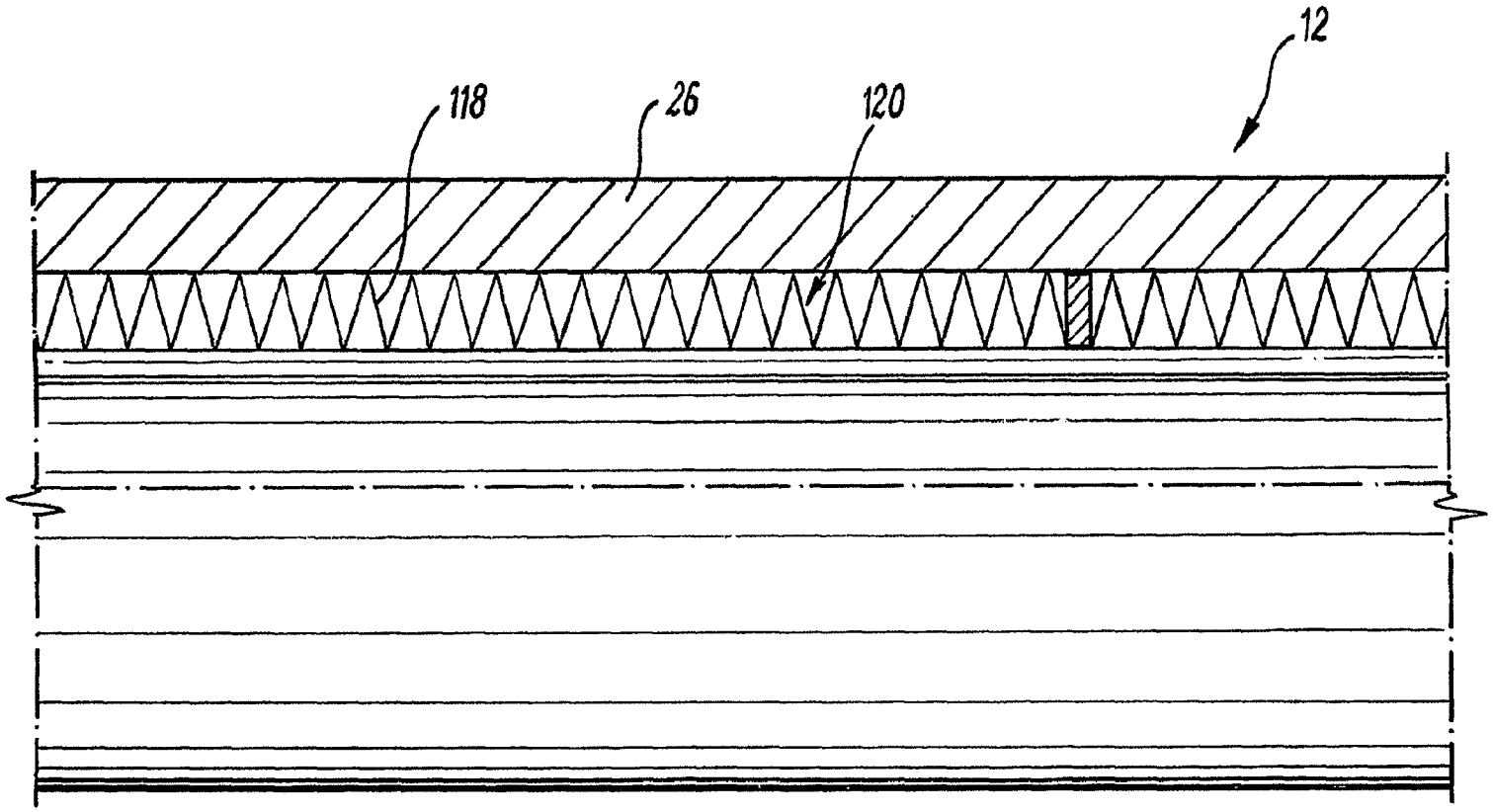
Figure 9:
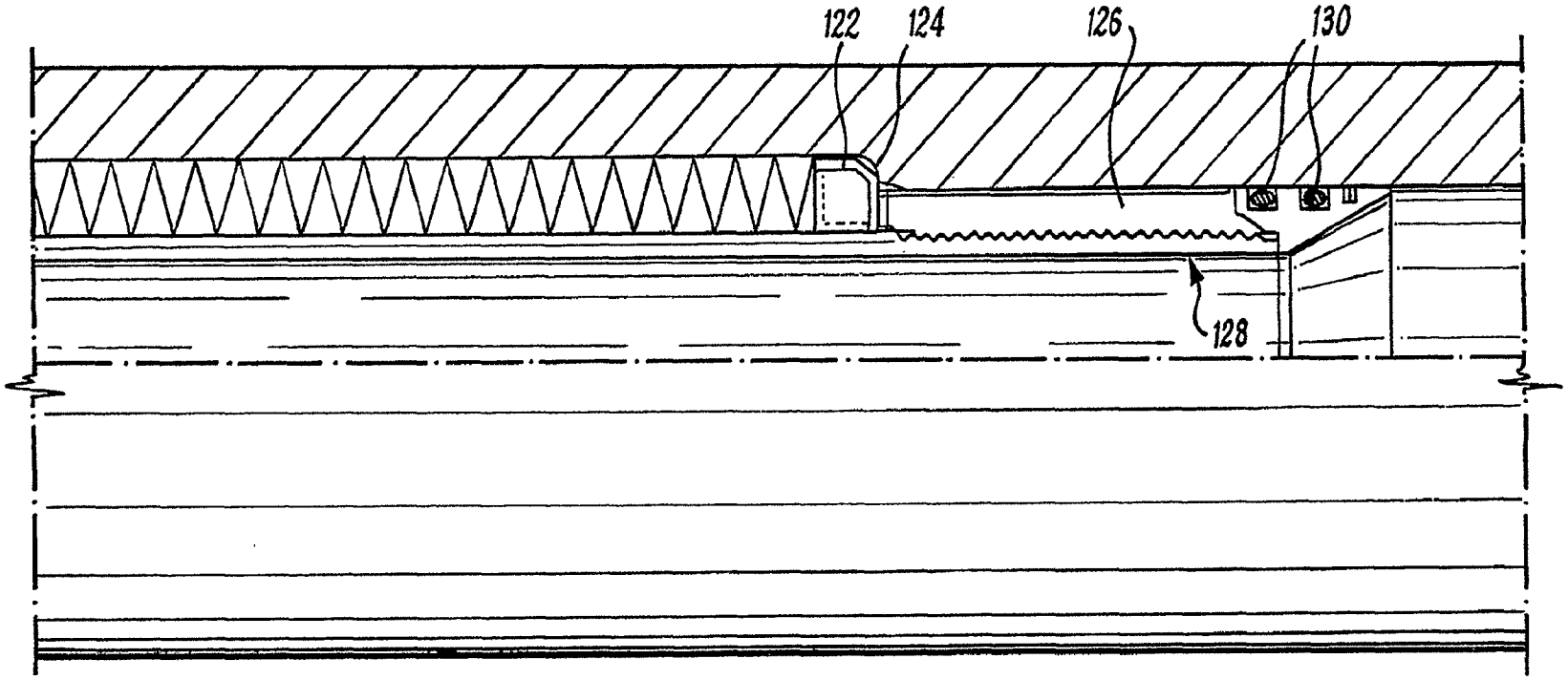
Figure 10:
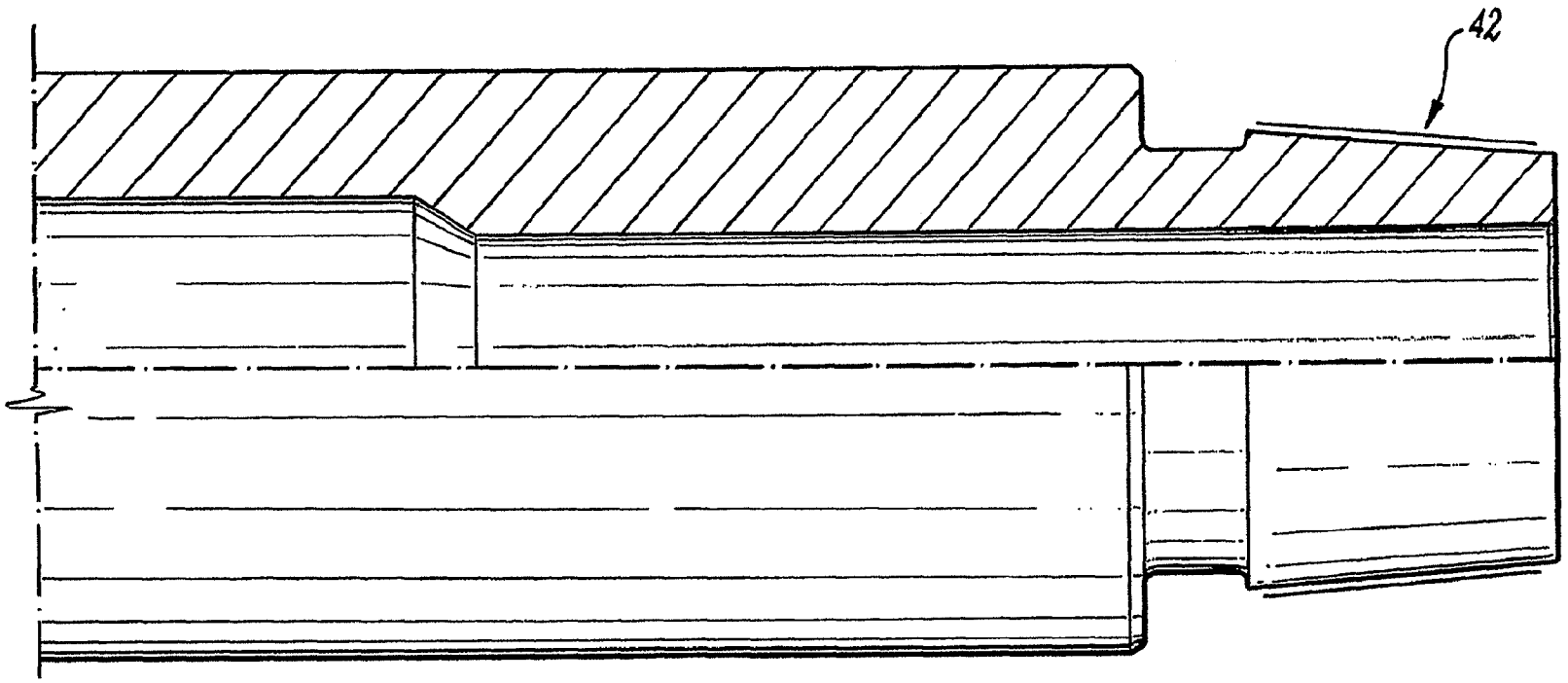

The valve seat assembly 10 generally comprises a deformable valve body in the form of a short cylindrical tube 36, and at least one locking element in the form of a dog or key 38 mounted for movement relative to the body between a retracted position, shown in FIGS. 1 and 2, and an extended position, shown in FIG. 7. In the illustrated embodiment, the assembly 10 includes three locking dogs 38 spaced equidistantly around a circumference of the body 36. The body 36 has a body bore 40 therethrough, and is deformable to permit passage of the ball 34 along the bore 40 and out of the body. However, in their extended positions, the locking dogs 38 are held in a position where the dogs describe an internal clearance which is equivalent to the diameter of the body bore 40. In this position, the dogs 38 restrict passage of the ball 34 along the body bore 40 and out of the body 36.

Figure 17:
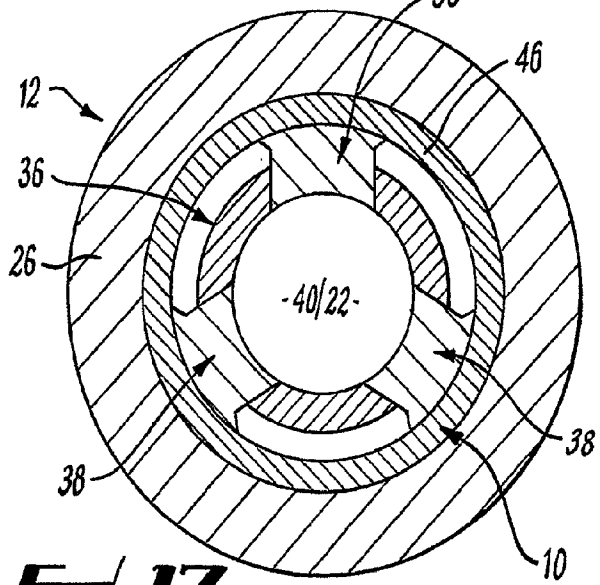
FIG. 17 is a sectional view of the circulation tool of FIGS. 6 to 10, taken along line A-A of FIG. 7.

The body 36 is typically of a plastics material, particularly PEEK, which has been found to perform well downhole under the relatively harsh conditions of high pressure, temperature and corrosive fluids that the body 36 is exposed to. The body bore 40 is dimensioned such that there is an interference fit between the ball 34 and the body 36. The ball 34 is dropped into the work string 14 at surface (topside), and is entrained in the fluid passing down through the string and thus carried into abutment with the valve body 36. The nature of the PEEK material of the body 36 is such that the ball 34 seats on and seals relative to the body 36, restricting further passage of fluid through the valve body bore 40. The body 36 is shown more clearly in the perspective, top, two side views (taken in the same direction as FIGS. 4 and 5) and sectional view (taken along line A-A of FIG. 7) of FIGS. 12 to 16, respectively. The assembly 10 is also shown in the cross-sectional view of the tool 12 shown in FIG. 17, which is taken along line A-A of FIG. 7.

The ball 34 is typically of a metal such as a steel and deforms the valve body 36, passing along the body bore 40, when the pressure of fluid behind (upstream) of the ball 34 is sufficiently high, generating a fluid pressure force acting through the ball 34 on the body 36.

The locking dogs 38 are of a material which is harder than that of the body 36, typically a metal such as a steel, and will not deform under the load exerted by the ball 34, or at least any deformation will not be sufficient to permit passage of the ball 34 along the body bore 40. Accordingly, with the dogs 38 in their extended positions, the dogs 38 will prevent passage of the ball 34 along the body bore 40 past the dogs, and thus prevent the ball 34 passing out of the body 36. The dogs 38 are located in apertures 41 extending through the body 36 in a radial direction, which open on to the body bore 40, as best shown in FIGS. 12 to 16.

In order to permit passage of the ball 34 along the bore 40 and out of the body 36, it is necessary to move the dogs 38 to their retracted positions. In these positions, the dogs 38 describe a clearance which is greater than a diameter of the ball 34 so that, with sufficient fluid pressure acting on the ball 34, the ball 34 may pass along the bore 40 and out of the body 36. Following such passage of the ball 34, the body 36 elastically recovers to the undeformed position which the body was in prior to landing of the ball 34 on the body 36.

As will be described below, the structure and method of operation of the assembly 10 permits selective activation of the circulation tool 12 to direct fluid through the flow ports 24 into the annulus 30.

The circulation tool 12, and its method of operation using the assembly 10, will now be described in more detail.

As noted above, the tool 12 includes an outer body 26. The outer body 26 is designed to be incorporated into the work string 14 in a pin-down configuration, and includes pin and box connections 42 and 44 at lower and upper ends, respectively, for coupling the tool 12 into the work string 14, in a fashion known in the art. An intermediate sleeve in the form of a filler sleeve 46 is located within the outer body 26, and is secured in place by a lock pin 48. The filler sleeve 46 is sealed relative to the outer body 26 by a pair of O-rings 50 at an upper end of the sleeve, and by an O-ring 52 which seals the lock pin 48 within a threaded bore 54. Mounted within apertures 56 further down the filler sleeve 46 are a series of indexing members, in the form of indexing dogs or keys 58.

An inner body 62 is mounted within the filler sleeve 46, and comprises an indexing sleeve 64, the valve seat assembly 10 and a valve seat assembly retainer in the form of a short retainer sleeve 68, which is threaded to an upper end 70 of the indexing sleeve 64. The retainer sleeve 68 secures the valve seat assembly 10 to the indexing sleeve 64, with the valve body 36 held between an end face 72 of the retainer sleeve 68 and an end face 74 of a ported sleeve 76. The retainer sleeve 68 is sealed relative to the outer body 26 by an O-ring 78, and tapers towards an upper end 80, to guide the ball 34 into the valve seat assembly bore 40.

The indexing sleeve 64 includes a series of apertures 82 which receive the locking dogs 38 and which permit movement of the dogs between their retracted and extended positions. A series of O-ring seals 84, 86, 88 and 90 seal the indexing sleeve 64 relative to the filler sleeve 46. A number of flow ports 92 extend through the indexing sleeve 64, and are aligned with corresponding ports 94 in the ported sleeve 76. Located between an end face 96 of the ported sleeve 76 and a shoulder 98 on the indexing sleeve 64 is a deformable ball seat 100, typically of a PEEK material, which is dimensioned to restrict the diameter of the tool bore 22 to a greater extent than the valve seat assembly 10. Typically, the valve seat assembly locking dogs 38, in their extended positions, will describe a diameter of 1.7" (2.27 sq inches) whereas the ball seat 100 will describe a ball diameter of 1.66" (2.16 sq inches).

An indexing channel 102 is defined in an outer surface 104 of the indexing sleeve 64, and extends around a circumference of the sleeve. The indexing dogs 58 engage within the channel 102 and control the axial and rotational position of the indexing sleeve 64 within the filler sleeve 46. Part of the indexing channel 102 is shown opened-out in the lower half of FIG. 7, which also illustrates the relationship between the indexing dogs 58 and the channel 102.

In more detail, the indexing sleeve 64 includes a number of first detent positions 106; a number of second, axially spaced second detent positions 108; and a number of intermediate, third detent positions 110, located axially between the first and second detent positions 106 and 108. The indexing sleeve 64 also includes a shoulder 112 which is shaped to abut a lower end 114 of the filler sleeve 46, such that the filler sleeve controls a maximum extent of movement of the indexing sleeve 64 in a direction towards an upper end of the tool 12, as will be described below.

A chamber 116 is defined between the indexing sleeve 64 and the outer body 26, and the filler sleeve 46 extends into the chamber 116. The chamber 116 extends down the tool 12, and a compression spring 118, piston or the like (not shown) is located within a lower portion 120 of the chamber 116. The spring 118 is seated on a spacer 122 which itself seats on a shoulder 124 defined by the outer body 26, and acts to bias the indexing sleeve 64 in a direction towards the upper end of the tool 12, towards the position shown in FIGS. 6 to 10.

The indexing sleeve 64 is threaded to a short sleeve 126 at a lower end 128, and the sleeve 126 is sealed relative to the outer body 26 by a pair of O-rings 130. These seals 130 isolate the chamber 116 from fluid ingress/egress at the lower end 128 of the indexing sleeve 64. At an upper end of the chamber 116, a pair of annular lip seals 132 and 134 are provided. The lip seal 132 is mounted in the filler sleeve 46, and seals the filler sleeve 46 relative to the outer body 26. The lip seal 134, which is of smaller diameter than the seal 132, seals the indexing sleeve 64 relative to the filler sleeve 46. The lip seals 132, 134 are each generally C-shaped in cross section, as shown in FIG. 7, and govern fluid flow into and out of the upper end of the chamber 116. Each lip seal 132, 134 has a pair of lip portions 136 defining an annular channel 138 therebetween. The lip portions 136 of the seal 132 face towards the outer body pin 42, whilst the lip portions 136 of the seal 134 face towards the outer body box 44.

This structure of the lip seals 132, 134 provides a restriction to fluid flow in a first axial direction, whilst allowing fluid flow in the second, opposite axial direction. In more detail, the lip seal 132 allows fluid flow into the chamber 116 in a first direction X (FIG. 7), whilst providing a restriction to fluid flow out of the chamber 116 in the direction Y. The lip seal 134 is arranged in opposite fashion. Flow past the lip seals 132, 134 is achieved when a pressure differential is created across the seals 132, 134. A positive pressure differential across seal 132 in the direction X will tend to close the channel 138, allowing flow of fluid into the chamber 116. In contrast, this pressure differential acting on the lip seal 134 will tend to enhance sealing abutment between the lip portions 136 of lip seal 134 and the filler sleeve 46/indexing sleeve 64, restricting fluid flow past the lip seal 134 into the chamber 116. A pressure differential in the opposite direction will have the corresponding, opposite effect.

Figure 18:
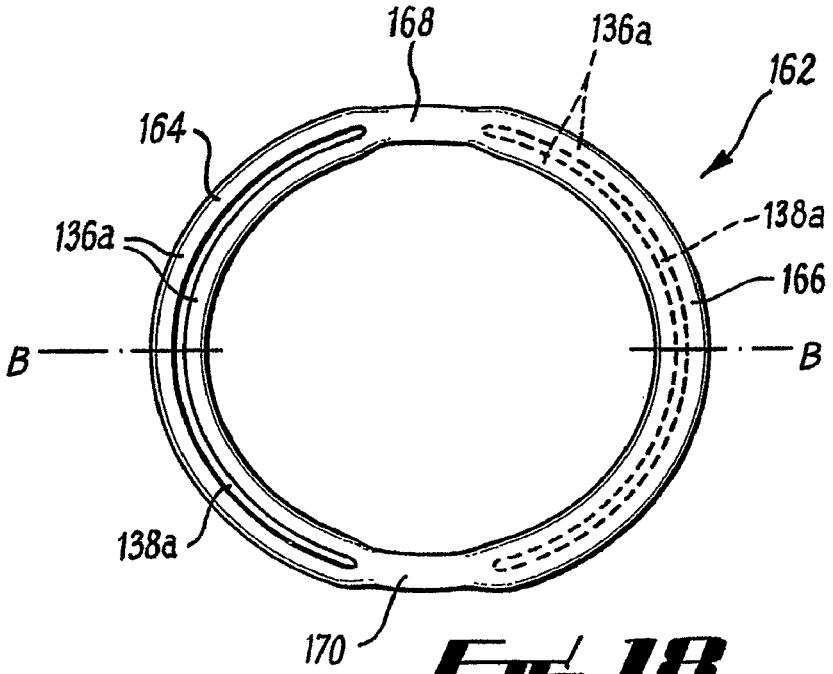
FIG. 18 is an end view of a seal in accordance with an embodiment of the present invention, the seal also forming part of a circulation tool in accordance with an alternative embodiment of the present invention.

Turning now to FIG. 18, there is shown an end view of a seal in accordance with an alternative embodiment of the present invention, the seal indicated generally by reference numeral 162. The seal 162 takes the form of a lip seal, and is suitable for incorporation into a downhole tool such as the circulation tool 12 of FIGS. 1 to 17, to perform the function of the lip seals 132 and 134, as will be described below. Like components of the seal 162 with the lips seals 132 and 134 share the same reference numerals with the addition of the suffix a. It will therefore be understood that a circulation tool in accordance with an alternative embodiment of the present invention, incorporating the lip seal 162, may be provided.

Figure 19:
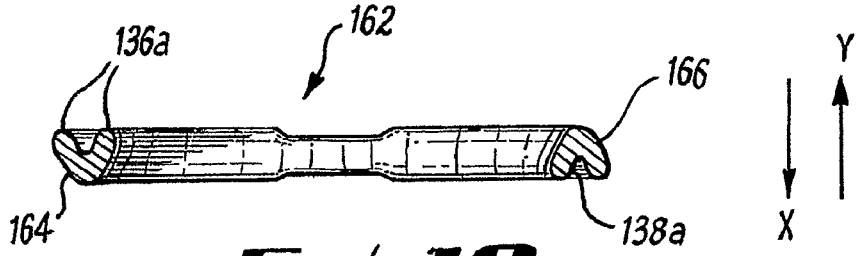
FIG. 19 is a cross-sectional view of the seal of FIG. 18, taken about the line B-B of FIG. 18.

The lip seal 162 is also shown in FIG. 19, which is a cross-sectional view of the seal taken about the line B-B of FIG. 18. The lip seal 162 comprises a first seal portion 164 and a second seal portion 166. Each of the seal portions 164 and 166 include lip portions 136*a* with channels 138*a* therebetween. The lip portions 136*a* of the first seal portion 164 face in an opposite direction to the lip portions 136*a* of the second seal portion 166.

The lip seal 162 is provided in a circulation tool of like structure to the tool 12, in place of the outer lip seal 132, and a conventional O-ring seal (not shown) is provided in place of the inner lip seal 134. However, it will be understood that the lip seal 162 may be provided in place of the inner lip seal 134 of the tool 12, and an O-ring seal in place of the outer lip seal 132. Equally, if desired, two such lip seals 162 (of different diameters) may be provided in place of both the lip seals 132 and 134.

The lip seal 162 is moulded and shaped to include conventional O-ring sections 168 and 170, which provide transitions between the first and second seal portions 164 and 166. In use, the first seal portion 164 permits fluid flow past the seal 162 in the direction Y and thus out of the chamber 116 of the tool 12, whilst restricting flow past the seal into the chamber 116 in the direction X. The second seal portion 166, having its lip portions 136*a* oriented in opposite fashion, permits fluid flow past the seal 162 in the direction X and thus into the chamber 116 of the tool 12, whilst restricting flow past the seal out of the chamber 116 in the direction Y. Accordingly, the first seal portion acts in a similar fashion to the inner lip seal 134 of the tool 12, whilst the second lip seal portion 166 acts in a similar fashion to the outer lip seal 132 of the tool 12. Equivalent function to the lip seals 132 and 134 is thus provided in a single lip seal.

The circulation tool 12 is shown in FIGS. 6 to 10 in a running-in configuration in which fluid flowing through the workstring 14 passes down through the tool bore 22 before exiting the tool and passing further downhole. This allows other wellbore operations to be carried out, such as wellbore cleaning using a mechanical scraper tool (not shown) and circulation of fluid from a bottom of the workstring (not shown) up the annulus 30 to surface. In this configuration, the locking dogs 38 are held in their extended positions by the filler sleeve 46.

Once the desired wellbore operation has been completed, and when it is desired to activate the circulation tool 12, the ball 34 is dropped into the string 14 at surface and flows under gravity and within fluid flowing through the workstring 14 down the string and into the tool 12. The ball 34 is guided into the valve seat assembly 10 by the tapered upper end 80 of the retainer sleeve 68. The ball 34, being of a larger diameter than the diameter of the valve body bore 40, is brought into sealing abutment with the valve body 36, in particular, with a chamfered seat 140. With the tool 12 in the configuration shown in FIGS. 6 to 10, the ball 34 then blocks the tool bore 22, preventing further flow down through the work string 14.

The pressure of fluid in the portion of the bore 22 above (upstream) of the ball 34 is then increased, to raise a fluid pressure force exerted on the valve body 36 by the ball 34. This causes the ball 34 to deform the valve body 36, passing down through the body bore 40. With the locking dogs 38 in their extended positions, further passage of the ball 34 is prevented and the ball is seated on ball seat portions 142 of the dogs 38. Flow through the tool 12 is still prevented by virtue of the interference fit between the ball 34 and the valve body 36.

The fluid pressure is then raised further, transmitting a force to the spring 118 through the locking dogs 38, a side wall 144 of the apertures 82 and the indexing sleeve shoulder 122. Once the fluid pressure has been raised to a sufficient level, the biasing force of the spring 118, acting to hold the indexing sleeve 64 in the FIGS. 6 to 10 position, is overcome and the sleeve 64 is translated axially downwardly relative to the outer body 26.

In the starting position of the indexing sleeve 64 shown in Gigs. 6 to 10, the indexing dogs 58 are in their first detent positions 106. The indexing sleeve 64 is translated downwardly until first inclined abutment surfaces 146 of the dogs 58 (inclined at 40 degrees relative to a main axis 148 of tool 12) come into contact with corresponding abutment surfaces 150 of the indexing channel 102. Further downward movement of the sleeve 64 causes a rotation of the sleeve, bringing the dogs 58 into their second detent positions 108. In this position of the indexing sleeve 64, the flow ports 92 have been translated to a position below (downstream) of the outer body flow ports 24. The flow ports 24 therefore remain closed such that fluid flow to the annulus 30 is still prevented. The dogs 38 are now in a position where they overlap flow ports 47 in the filler sleeve 46. The dogs 38 have radially outer surfaces 152 having stepped portions 154 of reduced outer diameter. When the locking dogs 38 are brought to the position where they overlap the flow ports 47, the dogs 38 snap radially outwardly a short distance, urged by the ball 34 and permitted by the stepped portions 154. Accordingly, parts of the dogs 52 extend into the flow port 47.

The dogs 38 are now in their retracted positions and no longer present a restriction to passage of the ball 34 through the valve body 36. The ball 34 is thus blown through the valve body bore 40 and exits the valve body 36. The fluid pressure force acting on the ball 34 is sufficiently high that the ball 34 is also blown through the second, smaller ball seat 100. It will be noted that the ball seat 100 is placed a short axial distance away from the valve seat assembly 10, to ensure that the high velocity of the ball 34, when it is blown through valve body 36, carries the ball 34 through the seat 100.

The ball 34 then continues on through the tool 12 downhole, and is typically caught in a ball catcher (not shown). The fluid pressure force acting on the spring 118 is now reduced and fluid flow through the tool bore 22 reopened. The spring 118 acts on the indexing sleeve 64, urging it upwardly. However, the indexing dogs 58 are now axially aligned with second abutment surfaces 156 defined by the indexing channel 102. These surfaces 156 are inclined at 35° to the tool main axis 148, and are brought into abutment with corresponding inclined abutment surfaces 158 on the dogs 58. The indexing sleeve 64 is thus further rotated and the dogs 58 are now in the third, intermediate detent positions 110. In this axial and rotational position of the indexing sleeve 64, the flow ports 94, 92 and 24 are aligned and fluid flow through the flow ports 24 to the annulus 30 is permitted. This allows a function such as a washing clean the inner wall 28 of the casing 18 to be carried out.

To enhance the flow of fluid to the annulus 30, a second, smaller diameter ball 160, shown in broken outline in FIG. 7, is dropped into the workstring 14 at surface, and passes down through the valve seat assembly 10 to seat on the second ball seat 100. This closes the tool main bore 22 below the second ball 160, directing all fluid flow through the flow ports 24 to annulus. If it is desired to reopen the tool main bore 22, the fluid pressure above the second ball 160 is raised, such that the ball 160 deforms the seat 100 and passes through the seat.

When it is desired to close flow to the annulus 30, a further ball of similar dimensions to the ball 34 is dropped into the workstring 14 at surface. With the indexing dogs 58 in their third detent positions 110, the locking dogs 38 have been returned to a position where they are supported in their extended positions by the filler sleeve 46, and present a restriction to the passage of a further ball through the valve seat assembly 10. Accordingly, the further ball is seated in a similar fashion to that described above in relation to the first ball 34, and pressuring-up translates the indexing sleeve 64 downwardly, bringing the dog abutment surfaces 146 into abutment with the indexing channel abutment surfaces 150. This rotates the indexing sleeve 64 and the dogs 58 are then returned to their second detent positions 108. The locking dogs 38 are then again de-supported and urged to their retracted positions and the further ball is blown through the valve body 36. This reopens the tool main bore 22, reducing the fluid pressure force acting on the spring 118, which returns the indexing sleeve axially upwardly to the position of FIGS. 6 to 10, where the dogs are in their first detent positions 106. The flow ports 24 are thus once again closed and all fluid flow is directed down through the main bore 22.

It will be understood that the tool 12 may be cycled between the above positions as many times as desired, limited only by the number of balls 34 which can be dropped down through the workstring 14 and caught or discharged into the wellbore 16.

The operation of the lip seals 132, 134 will now be described in more detail. The tool 12 is coupled into the workstring 14 at surface and run downhole. Preparations for running the circulation tool 12 include charging the chamber 116 with oil, to lubricate the indexing dogs 58, channel 102 and spring 118. Oil charged to the chamber 116 enters the indexing channel 102 past the indexing dogs 58. The oil charged into the chamber 116 is thus at atmospheric pressure and, during run-in, the tool 12 is exposed to the elevated fluid pressures found downhole. Wellbore fluids thus leach into the chamber 116, to equalize pressure across the lip seals 132, 134. As the lip seal 132 permits fluid flow in the direction of the arrow X, fluid enters the chamber 116 along the interface between the outer body 26 and the filler sleeve 46. These fluids include residues of drilling fluid used in earlier downhole procedures and remaining within the wellbore 16. When the circulation tool is pulled-out, pressure equalisation occurs in the reverse direction, and fluid flows out of the chamber 116 past the lip seal 134, which permits fluid flow in the direction Y. Providing such an arrangement of lip seals 132, 134 assists in discharging the fluid that entered the chamber 116 during run-in when the tool 12 is pulled-out.

Additionally and as described above, it will be understood that during use of the circulation tool 12, the indexing sleeve 64 is repeatedly translated up and down relative to the outer body 26. This movement of the indexing sleeve 64 causes fluid to leach out of the chamber 116 past the lip seal 134 (during a downward movement of the indexing sleeve 64 in the direction X), and fluid leach into the chamber 116 past the lip seal 132 during translation of the indexing sleeve 64 upwardly (in the direction of the arrow Y). Again, providing this arrangement of lip seals 132, 134 assists in discharging the fluid which has leached into the chamber 116 (during a downward movement of the indexing sleeve 64) out of the chamber 116 during an upward movement.

Where the lip seal 162 is provided in place of one or both of the lip seals 132 and 134, it will be understood that fluid ingress into the chamber 116 (during run-in or an upstroke of the filler sleeve 46) is permitted past the seal portion 166, but restricted by the seal portion 164. In contrast, fluid egress from the chamber 116 (during pull-out or a downstroke of the filler sleeve 46) is permitted past the seal portion 164, but restricted by the seal portion 166.

Rotational movement of the indexing sleeve 64 to locate the indexing dogs 58 successively in the detent positions 106, 108 and 110 is facilitated by the polygonal shape of the indexing dogs 58, and by the particular angles of the dog abutment surfaces 146, 158 and the corresponding surfaces 150, 156 of the indexing channel 102. In particular, each of the dog abutment surfaces 146 and 158 are generally planar, and are inclined relative to the tool main axis 148 at angles which correspond to those of the indexing channel abutment surfaces 150, 156. In this fashion, a more effective force transfer between the dogs 58 and the indexing sleeve 64 is provided when these abutment surfaces 146, 150 and 158, 156 are brought into abutment. Furthermore, providing such angled abutment surfaces 146, 158 on the indexing dogs 58 permits an axial length of the dogs to be increased, relative to conventional indexing dogs, which are typically cylindrical in cross-section. This can also be achieved whilst maintaining or potentially reducing a width in a direction Z (FIG. 7) of the dogs 58. This is because primary forces exerted on the dogs 58 are directed along the main axis 148 of the tool 12, and thus in the directions X or Y. Force transfer in a circumferential direction of the tool 12 are lower.

Various modifications may be made to the foregoing without departing from the spirit and scope of the present invention.

For example, the valve body may be of another suitable deformable material, such as an alternative plastics material. The valve seat on the valve body may be defined by a valve seat member coupled to or mounted on the valve body.

Other types of valve member may be utilised, such as generally conical darts, where an operating diameter of the valve member is the maximum outer diameter of the dart.

The locking element may extend or protrude into the valve body bore, when in the extended position, to restrict passage of the valve member along the bore and out of the valve body.

The aperture in the valve body for the locking element may be disposed such that an axis of the aperture is inclined or declined relative to a radius of the valve body.

In the methods of the present invention, the valve member may be brought into substantial sealing abutment with the valve body, permitting a partial flow of fluid along the conduit past the valve member; however, the valve member will greatly reduce the fluid flow.

The conduit, from which fluid flow is directed externally, may be any type of downhole conduit, in particular a body of an alternative downhole tool. In a further alternative, the conduit may be a section of alternative downhole tubing, or indeed of tubing used in alternative environments such as within a pipeline. The indexing sleeve may be adapted to be mounted within on and thus externally of a body of a downhole tool, and the indexing channel may be in an inner surface of the indexing sleeve.

The invention claimed is:

1. An apparatus comprising:

a circulation tool comprising a tubular body having a main bore and at least one flow port in a wall thereof;

a valve seat assembly, movably mounted within the main bore of the tubular body, comprising a valve body adapted to sealingly receive a valve member, the valve body having a body bore therethrough having a total length defined between a first end of the body bore and a second end of the body bore located opposite with respect to the first end of the body bore, wherein the body bore has an undeformed diameter that is less than an operating diameter of the valve member to provide an interference fit with the valve member, the undeformed diameter of the body bore, that is less than the operating diameter of the valve member, is at least provided at the first end of body bore extending towards the second end of the body bore and at the second end of the body bore extending towards the first end of the body bore, and the valve body being formed from a plastics material to permit passage of the valve member along the body bore and out of the body as the valve body is deformed by the valve member; and at least one locking element movably mounted within the main bore of the tubular body and configured to alternate between a retracted position in which the at least one locking element permits passage of the valve member along the body bore and out of the valve body, and an extended position in which the at least one locking element restricts passage of the valve member along the body bore and out of the valve body, wherein, if in the extended position, a portion of the at least one locking element is positioned between a first end of the valve body and a second end of the valve body located opposite with respect to the first end of the valve body.

2. The apparatus of claim 1 wherein the locking element is of a material which is less deformable than polyetheretherketone.

3. The apparatus of claim 1 wherein the locking element is of a material having a higher material hardness than the plastics material of the valve body.

4. The apparatus of claim 1 wherein the locking element is of a metal.

5. The apparatus of claim 1 wherein the valve body defines a valve seat adapted to sealingly about the valve member.

6. The apparatus of claim 1 wherein the valve seat is defined by a surface of the valve body.

7. The apparatus of claim 1 wherein, in the extended position, the locking element defines a clearance within the body bore which is equal to or less than the diameter of the body bore in an undeformed state.

8. The apparatus of claim 1 wherein the locking element extends into the body bore, if located in the extended position.

9. The apparatus of claim 1, wherein in the retracted position, the locking element describes a diametrical clearance within the body bore which is greater than the diameter of the body bore in an undeformed state, and greater than a diameter of the valve member.

10. The apparatus of claim 1 comprising a support sleeve in which the valve body is mounted, the support sleeve having an aperture adapted to receive the locking element and to permit outward movement of the locking element relative to the valve body.

11. The apparatus of claim 10 wherein the valve body is mounted for axial movement within and relative to the support sleeve, and wherein axial movement of the valve body relative to the support sleeve facilitates movement of the locking element between the extended and retracted positions.

12. The apparatus of claim 11 wherein the valve body is movable relative to the support sleeve between a first position in which the locking element is in the extended position, restricting passage of the valve member along the valve body bore and out of the valve body; and a second position in which the locking element is in the retracted position, permitting passage of the valve member along the body bore and out of the body.

13. The apparatus of claim 12 wherein the valve body is biased towards the first position.

14. The apparatus of claim 12 wherein the valve body is movable to a third position in which the locking element is again in the extended position.

15. The apparatus of claim 14 wherein the third position is an intermediate position at a location axially between the first and second positions.

16. An apparatus comprising:

a circulation tool comprising a tubular body having a main bore and at least one flow port in a wall thereof;

a valve seat assembly, movably mounted within the main bore of the tubular body, comprising a valve body adapted to sealingly receive a valve member, the valve body having a body bore therethrough having a circumference and a total length defined between a first end of the body bore and a second end of the body bore located opposite with respect to the first end of the body bore, wherein the body bore has an undeformed diameter that is less than an operating diameter of the valve member to provide an interference fit with the valve member, the undeformed diameter of the body bore, that is less than the operating diameter of the valve member, extends along at least a majority of the total length of the body bore over at least a portion of the circumference of the body bore, and the valve body is configured to permit passage of the valve member along the body bore and out of the body as the valve body is deformed by the valve member; and at least one locking element movably mounted within the main bore of the tubular body and configured to alternate between a retracted position in which the at least one locking element permits passage of the valve member along the body bore and out of the valve body, and an extended position in which the at least one locking element restricts passage of the valve member along the body bore and out of the valve body, wherein the valve body comprises at least one aperture in which the at least one locking element is movably mounted for movement between the extended position and the retracted position.

* * * * *